United States Patent [19]

Tretick

[11] 4,095,842

[45] Jun. 20, 1978

[54] SEAT FOR GARDENING AND THE LIKE

[75] Inventor: Julius Tretick, Westerlo, N.Y.

[73] Assignee: Tredhill Manufacturing Co. Inc., N.Y.

[21] Appl. No.: 791,571

[22] Filed: Apr. 27, 1977

[51] Int. Cl.[2] ..... A47C 1/00

[52] U.S. Cl. ..... 297/4; 297/345

[58] Field of Search ..... 297/4, 345; 248/188.9, 248/188.8

[56] References Cited

U.S. PATENT DOCUMENTS

| | | | |
|---|---|---|---|
| 359,921 | 3/1887 | Cowan | 297/4 |
| 872,739 | 12/1907 | McDaniel | 297/4 |
| 1,408,729 | 3/1922 | Green | 297/345 X |
| 1,988,860 | 1/1935 | Smith | 248/188.9 |
| 2,541,483 | 2/1951 | Rowden | 297/4 |
| 2,692,637 | 10/1954 | Rainwater | 297/345 |
| 3,254,362 | 6/1966 | Rasor et al. | 248/188.8 X |

FOREIGN PATENT DOCUMENTS

| | | | |
|---|---|---|---|
| 595,508 | 12/1947 | United Kingdom | 297/345 |

*Primary Examiner*—Francis K. Zugel

*Attorney, Agent, or Firm*—Larson, Taylor and Hinds

[57] ABSTRACT

A "wearable" seat is provided for use in gardening or the like. The seat includes a generally U-shaped frame including side portions and a substantially straight base portion, and a seat member which is adjustably mounted for vertical movement between the side portions of the frame. A back support assembly, including a mounting bar and a back plate, is secured to the upper ends of the frame and a belt secured to the back plate enables the device to be strapped to the waist of the user. The bar and/or the back plate are pivotable to accommodate the device to the body of the user for both standing and sitting positions.

12 Claims, 4 Drawing Figures

SEAT FOR GARDENING AND THE LIKE

FIELD OF THE INVENTION

The present invention relates to a "wearable" seat assembly for use in crop picking, gardening and the like wherein the seat assembly is releasably attached to, or "worn" by, a user so that the seat assembly is transported with the user during movement from place to place and is available to be sat upon during horticultural chores such as weeding.

BACKGROUND OF THE INVENTION

Farm and garden chores such as weeding and cultivating can be back-breaking labor and a number of devices have been developed to reduce the discomfort that can be associated with such chores. Devices of this type which are of particular interest here include stools developed many years ago for picking cotton and the like which are strapped to the body of the user so that the user has his hands free and is free to move around without having to carry the stool. Examples of such stools are disclosed in U.S. Pat. Nos. 432,560 (Ray) and 759,809 (Farely). The Ray patent discloses a cotton picker's stool which comprises a seat, a central supporting post attached to the seat and including a base, waist and shoulder straps for attaching the seat to the user, and, in one embodiment, a supporting brace secured to the supporting post. The Farely patent discloses a device similar to the Ray device which comprises a seat having side arms to which side straps are attached. The side straps are connected to a buckled waist belt. A further early patent which discloses a somewhat similar device is U.S. Pat. No. 359,921 cowan) which concerns a portable, occupant attached milking stool. A later patent of more direct interest is U.S. Pat. No. 2,541,483 (Rowden) which discloses a gardener's stool which is secured to the user or wearer by means of lap belts and which includes a pair of curved rocker legs that are said to facilitate leaning of the chain in any desired direction. A final patent of possible interest is U.S. Pat. No. 2,465,104 (Kullack) which discloses a chair including a vertically adjustable seat.

SUMMARY OF THE INVENTION

In accordance with the present invention, an improved seat or stool is provided which is adapted to be "worn" by a user so that the seat is transported with the user during movement of the user from place to place and is readily available to be sat upon when performing farm or garden chores such as described above. The seat of the invention is both rugged and lightweight, is substantially less cumbersome than the devices of the prior art, is relatively inexpensive to manufacture, and, in general, provides more comfort to the user than prior art devices. The seat is positioned closed to the body of a user when the user is walking around and can be brought into use with a minimum of effort.

According to a preferred embodiment thereof, the seat device of the invention comprises a generally U-shaped frame member including side portions and a substantially straight base portion, a seat member which is adjustable mounted between the side portions of the frame member, a back support assembly including a bar member and a back plate mounted on the bar member, and a belt means which is attached to the back plate and which, in use, fits around the waist of the user so as to releasably secure the seat device to the user. The straight base portion of the frame member affords a stable support base when the seat is in use and, advantageously, this base portion is provided with spaced pads to enhance this stability. The back plate adds to the comfort of the user and together with the remainder of the back support assembly provides a mounting for the belt means which enables the whole device to hang down behind the user close to the body of the user. This feature can be contrasted with prior art devices such as that disclosed in the Rowden patent which are particularly cumbersome when the user is in a standing position.

Preferably, the device of the invention enables pivoting of the bar member as well as the back plate so that the device can be properly oriented with respect to the body of the user in both a sitting and standing position, in accordance with the user's wishes. The bar member is advantageously mounted on the frame by means of rod-like extensions which are telescopically received in the ends of the tubular side portions of the frame in order. Further, this mounting is preferably adjustable and this adjustment, together with the adjustment of the position of the seat member, enables the seat device to be "tailored" to the needs of a wide variety of users.

Other features and advantages of the invention will be set forth in, or apparent from, the detailed description of a preferred embodiment found hereinbelow.

DESCRIPTION OF THE PREFERRED EMBODIMENTS

Figure 1:
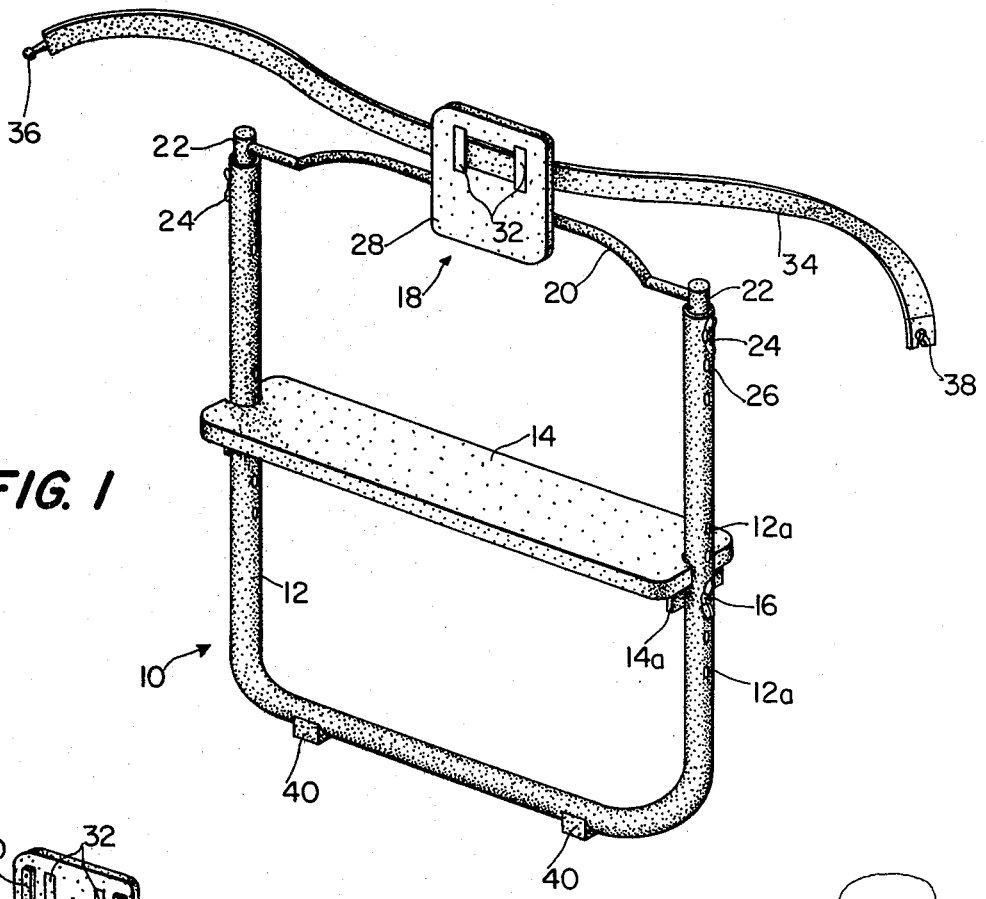
FIG. 1 is a perspective view of the seat device of the invention.

Referring to FIG. 1, a perspective view of the "squatting" seat of the invention is shown. The seat, which is generally denoted 10, includes a generally U-shape frame 12 which can, for example, be fabricated of 1-inch aluminum tubing. A seat member 14 is adjustable mounted between the legs of frame 12. To this end, seat member 14 is provided with downwardly depending flanges **14*a* at the opposite ends thereof. These flanges can, for example, be formed by the depending leg of an L-shaped bracket whose other leg is secured to the bottom of the frame member. Flanges 14*a* include a bolt hole which is selectively aligned with a series of adjustment holes 12*a* which are spaced vertically along the legs of frame 12 so as to vary the vertical position of the seat member 14 in frame 12. The seat member 14 is releasably secured to the frame 12 by a wing nut 16** which engages the screw or bolt which extends through the aligned holes referred to.

A back bar assembly 18 is adjustably mounted at the top of frame 12. The back bar assembly includes a central bar member 20 and a pair of adjustable extensions 22 located at the opposite ends of bar member 20. As illustrated, the bar member 20 is bowed in the middle thereof to enable one to sit more comfortably on seat member 14 without being obstructed by bar member 20. Bar member 20 is pivotably mounted in extensions 22 which are, in turn, telescopically received in the ends of the hollow legs of frame 12. A pair of wing nuts 24 are used in conjunction with vertically spaced adjustment holes 26 formed in the ends of the legs of frame 12 and a mating hole or aperture in extension 22 to provide vertical adjustment of the back bar assembly 18.

Figure 2:
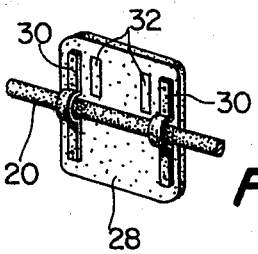
FIG. 2 is a detail, in perspective, of the other side of the back support plate shown in FIG. 1.

A back plate 28 is pivotably mounted on central bar member 20 (see FIG. 2). A pair of spaced mounting brackets 30 are secured to one side of back plate 28 and form a loop portion through which the bar member 20 extends, thus enabling pivoting of the back plate. Back plate 28 also includes a pair of spaced slots or apertures 32 through which a belt 34 extends. Belt 34 can take a number of different forms and in the illustrated embodiments includes a ball projection 36 at the end thereof and a reciprocally shaped recess 38 at the other end thereof for providing rapid securing and release of the belt.

A pair of pads 40 are secured to the central connecting leg of frame 12 in spaced relationship so as to provide a more stable base for the seat.

Figure 3:
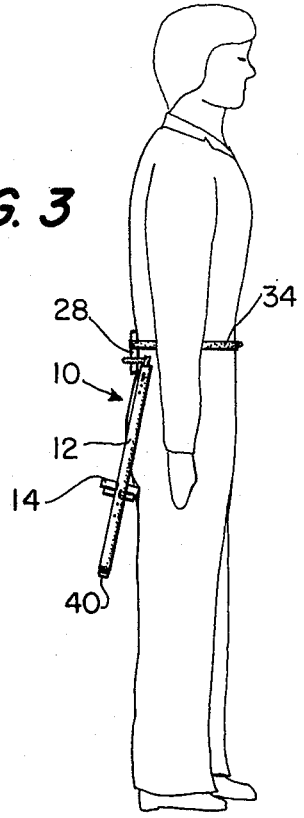
FIGS. 3 and 4 are diagrammatic representations of the seat device of the invention when in use, FIG. 3 showing the user standing and FIG. 4 showing the user sitting on the seat device.
Figure 4:
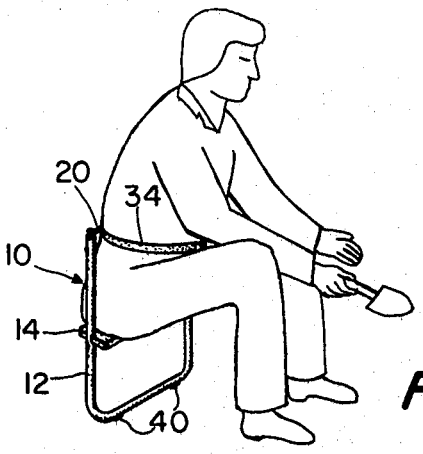

The use of the seat of the invention can perhaps be best appreciated from considering FIGS. 3 and 4. In FIG. 3, the seat 10 is shown in the rest position it assumes when the "wearer" or user is standing. The seat 10 is attached to the user by means of bolt 34 and, as is shown, the frame 12 and seat member 14 hang down behind the user from back plate 28. As illustrated, the seat 10 is supported close to the body of the user with the seat member 14 being disposed just below the buttocks. In FIG. 4, the seat 10 is shown in the operative position it assumes when the user is sitting on the seat. It should be noted that a major feature of the invention is that the seat member 14 automatically swings under the user as the user assumes a squatting position without the need for the user to guide the seat member 14 into place. The belt 34 again serves in securing the seat 10 to the user while the user sits on the seat member 14. As noted above, the bowed shaped of back bar 20 is such as to permit one to sit on the seat member 14 without being obstructed by the back bar assembly 18. Moreover, the various adjustments referred to above enable the seat 10 to be adjusted to suit the needs of the individual user.

In accordance with a further embodiment of the back plate 28, the plate is made out of a flexible material, and the mounting brackets 30 are replaced by a pair of holes located near the bottom edge of the back plate and disposed inwardly of the edges thereof. The back plate is flexed so that the back bar 20 extends through these holes and a pair of rubber grommets located on the back bar on opposite sides of the back plate serve to maintain the back plate in the center of the back bar.

Although the invention has been described relative to exemplary embodiments thereof, it will be understood that other variations and modifications can be effected in these embodiments without departing from the scope and spirit of the invention.

I claim:

1. A wearable seat device adapted to be attached to the person of a user for use in gardening and the like, said seat device comprising:

a generally U-shaped frame member including a pair of side portions and a substantially straight base portion;

a seat member;

means for adjustably mounting said seat member between the side portions of said frame member extending between the upper ends of the side portions of said frame members intermediate the ends thereof;

a belt support assembly including a bar member extending between the upper ends of the side portions of said frame member and a belt mounting plate mounted on said bar member;

means for securing said belt support assembly to said frame member; and belt means, attached to said belt mounting plate, for detachably securing said seat device to the person of a user, said belt means, in use, surrounding the waist of the user such that said frame member extends downwardly therefrom behind the user in close proximity to the body of the user.

2. A seat device as claimed in claim 1 wherein said frame member comprises a hollow tubing and wherein said means for securing said belt support assembly to said frame member includes first and second rod-like extensions which are telescopically received in the ends of the side portions of said frame member.

3. A seat device as claimed in claim 2 further comprising means for adjusting the amount which said extensions extend into the ends of said frame member.

4. A seat device as claimed in claim 2 further comprising means for pivotably mounting the ends of said bar member in said extensions.

5. A seat device as claimed in claim 4 further comprising means for pivotably mounting said belt mounting plate on said bar member.

6. A seat device as claimed in claim 1 further comprising means for pivotably mounting said belt mounting plate on said bar member.

7. A seat device as claimed in claim 6 wherein said means for pivotably mounting said belt mounting plate comprises first and second spaced brackets which are secured to said back plate and which define spaced apertures through which said bar member extends.

8. A seat device as claimed in claim 1 further comprising means for pivotably mounting said belt mounting plate relative to said frame member.

9. A seat device as claimed in claim 1 wherein said means for adjustably mounting said seat member between the side portions of said frame member comprises downwardly depending flange means located at the ends of said seat member and adjustment means for selectively securing said flange means to said side portions.

10. A seat device as claimed in claim 9 further comprising spaced pads secured to said straight base portion of said flange member.

11. A wearable seat device adapted to be attached to the person of a user for use in gardening and the like, said seat device comprising:

a generally U-shaped frame member including a pair of side portions and substantially straight base portion;

a seat member;

a belt support assembly including a bar member, a belt-mounting member mounted on said bar member and means for providing pivoting of said belt-mounting member relative to said frame member;

means for securing said belt support assembly to said frame member; and belt means, attached to said belt-mounting member, for detachably securing said seat device to the person of a user, said belt means, in use, surrounding the waist of the user such that said frame member extends downwardly therefrom behind the user in close proximity to the body of the user.

12. A device as claimed in claim 11 wherein said bar member includes a central straight portion and curved portions at the ends thereof and wherein said seat member comprises a rigid member.

* * * * *